US006691899B2

(12) United States Patent
Sung

(10) Patent No.: US 6,691,899 B2
(45) Date of Patent: Feb. 17, 2004

(54) DISPENSING GUN HAVING PRESSURE RELIEVING DEVICE

(75) Inventor: Chia Hsien Sung, Taichung (TW)

(73) Assignee: Kent Bridge Enterprise Co., Ltd., Taichung (TW)

( * ) Notice: Subject to any disclaimer, the term of this patent is extended or adjusted under 35 U.S.C. 154(b) by 0 days.

(21) Appl. No.: 10/188,237

(22) Filed: Jul. 3, 2002

(65) Prior Publication Data

US 2004/0004093 A1 Jan. 8, 2004

(51) Int. Cl.[7] ..... B67D 5/40
(52) U.S. Cl. ..... 222/391
(58) Field of Search ..... 222/327, 391

(56) References Cited

U.S. PATENT DOCUMENTS 1,986,166 A * 1/1935 Schneider ..... 222/391
4,009,804 A * 3/1977 Costa et al. ..... 222/391
5,156,305 A 10/1992 Eyre ..... 222/327
5,217,213 A 6/1993 Lii ..... 269/6
5,381,931 A * 1/1995 Chang ..... 222/391
5,887,765 A * 3/1999 Broesamel ..... 222/391

* cited by examiner

*Primary Examiner*—Phillippe Derakshani
(74) *Attorney, Agent, or Firm*—Charles E. Baxley

(57) ABSTRACT

A dispensing gun includes a stock having a frame for holding a cartridge, a rod slidably engaged through the stock and having a plunger for moving a viscous material out of the cartridge. A trigger and an actuating plate may move the rod incrementally and forwardly and rearwardly relative to the stock. A release plate is engaged on the rod for limiting the rearward movement of the rod relative to the stock. A spring member is engaged with the release plate for moving the rod forwardly and/or for moving the release plate away from an abutment of the stock.

6 Claims, 4 Drawing Sheets

DISPENSING GUN HAVING PRESSURE RELIEVING DEVICE

BACKGROUND OF THE INVENTION

1. Field of the Invention

The present invention relates to a dispensing gun, and more particularly to a dispensing gun for dispensing viscous materials, such as thick liquid, pasty materials, or mastic caulking materials.

2. Description of the Prior Art

Various kinds of typical dispensing guns have been developed for dispensing viscous materials, such as thick liquid, pasty materials, or mastic caulking materials which are normally retained in a cartridge having a discharge nozzle, and having an open end, and a cup-shaped piston slidably received in the cartridge.

One of the typical dispensing guns is disclosed in U.S. Pat. No. 5,217,213 to Lii, and comprises a rod slidably received in a disc and including a rack formed or provided therein, and a pair of pawls biased to engage with the rack for allowing the rod to be moved forward step by step, and in order to force the cup-shaped piston forward and thus to force the viscous materials out of the cartridge. The pawls may be used for forcing or pushing the rod forward step by step only, such that the viscous materials may be pressurized by the piston, and may be caused to move out of the cartridge continuously. Much of the viscous materials may thus be forced out of the cartridge, and may be wasted.

U.S. Pat. No. 5,156,305 to Eyre discloses another dispensing gun including a rod slidably received in a stock, a catch or an actuating plate engaged on the rod for moving the rod forward step by step with a trigger, a release plate engaged onto the rod, and a bush engaged with the rod and the release plate for moving the rod backward after the rod is moved or forced forward by the actuating plate, in order to release the pressure of the viscous materials, so as to prevent the viscous materials from being continuously moved or forced outward of the cartridge.

However, when the rod is moved rearward or backward by the release plate, a hollow space may be formed in the front end of the cartridge, such that, next time, when the rod is forced forward by the actuating plate again, the piston may not move or force any viscous materials out of the cartridge, until the air in the hollow space formed in the front end of the cartridge is forced out of the cartridge, or until the viscous materials are pressurized again by the piston. The actuating plate is thus required to be actuated many times, in order to force the required amount of mastic caulking materials out of the cartridge.

In addition, when the hollow space is formed in the front end of the cartridge and when the rod is moved rearward or backward by the release plate, the air may be drawn into the cartridge, such that the mastic caulking materials may be easily hardened by the air. Furthermore, when the dispensing gun is directed upward or downward, the bush may not suitably engage with the release plate, and the rod thus may not be actuated or moved rearward by the release plate, such that the viscous materials may still be caused to move out of the cartridge continuously.

The present invention has arisen to mitigate and/or obviate the afore-described disadvantages of the conventional dispensing guns.

SUMMARY OF THE INVENTION

The primary objective of the present invention is to provide a dispensing gun including a pressure relieving device for relieving the pressure of the viscous materials or the mastic caulking materials, and for preventing the viscous materials or the mastic caulking materials from moving out of the cartridge continuously.

The other objective of the present invention is to provide a dispensing gun including a pressure relieving device for preventing the air from moving into the cartridge and for preventing the viscous materials or the mastic caulking materials from being hardened by the air.

In accordance with one aspect of the invention, there is provided a dispensing gun for dispensing a viscous material received in a cartridge, the cartridge including a piston slidably received therein for moving the viscous material out of the cartridge, the dispensing gun comprising a stock including a handle and at least one guide orifice, and including a frame for holding the cartridge therein, a rod slidably engaged through the guide orifice of the stock, and including a first end having a plunger provided thereon for engaging with the piston of the cartridge, means for moving the rod forwardly and rearwardly relative to the stock to force the viscous material out of the cartridge, means for limiting a rearward movement of the rod relative to the stock, and means for retrieving the rod forwardly to force the plunger to engage with the piston of the cartridge.

The limiting means includes an abutment extended from the stock, and a release plate having a hole for loosely receiving the rod. The release plate is engaged with the abutment of the stock to limit the rearward movement of the rod relative to the stock when the release plate is moved rearwardly by the rod.

A device may be provided for biasing the release plate to engage with the abutment of the stock, and/or for tilting the release plate relative to the rod.

The retrieving means includes a spring member having a first portion engaged with the abutment, and having a second portion engaged with the release plate, to bias the release plate away from the abutment of the stock. The second portion of the spring member includes at least one leg engaged through and hooked with the release plate.

The moving means includes an actuating plate having an aperture formed therein for receiving the rod, a trigger pivotally secured to the stock and having an actuating pin for engaging with the actuating plate, and means for biasing the actuating plate to engage with the actuating pin of the trigger.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
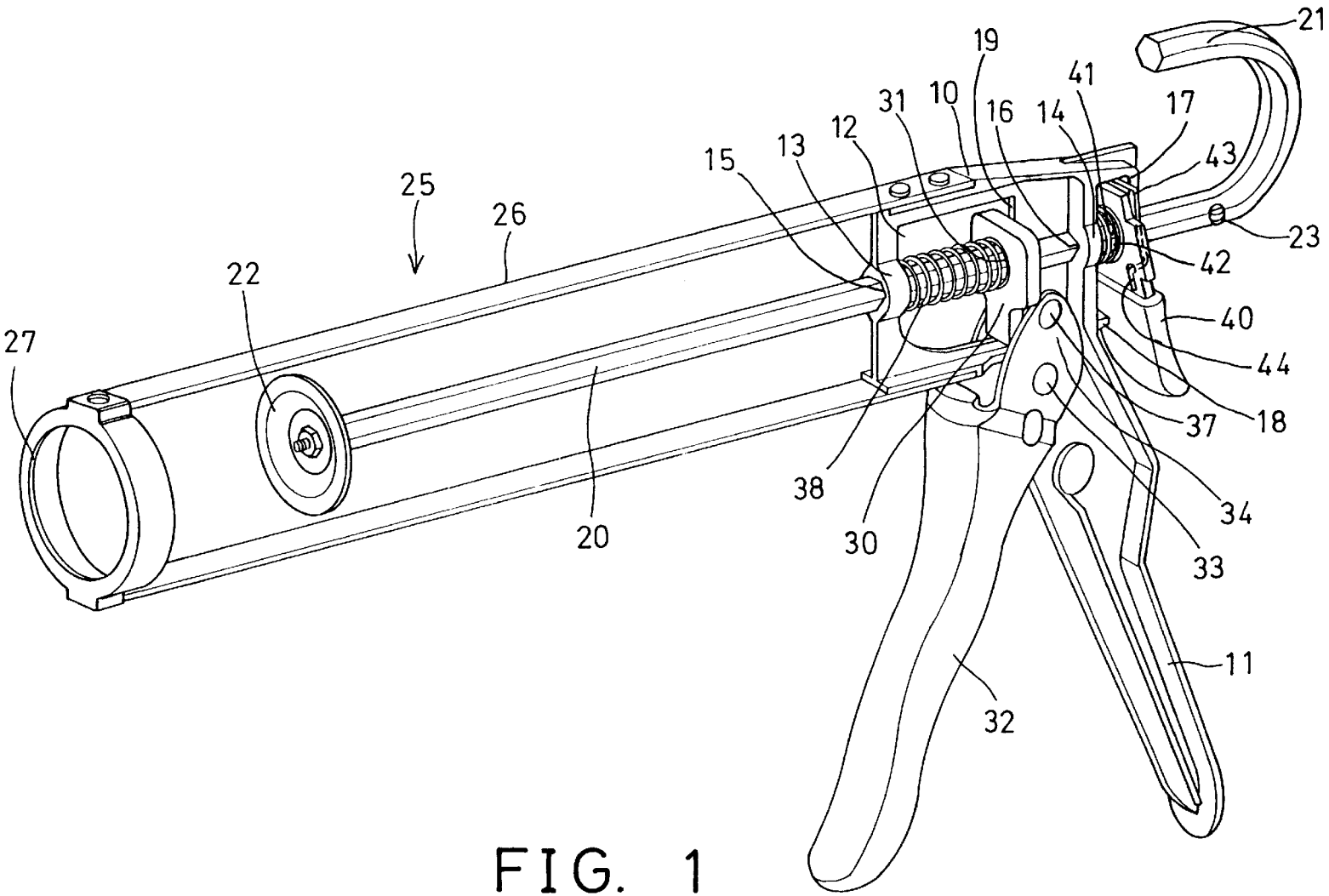
FIG. 1 is a perspective view of a dispensing gun in accordance with the present invention.
Figure 2:
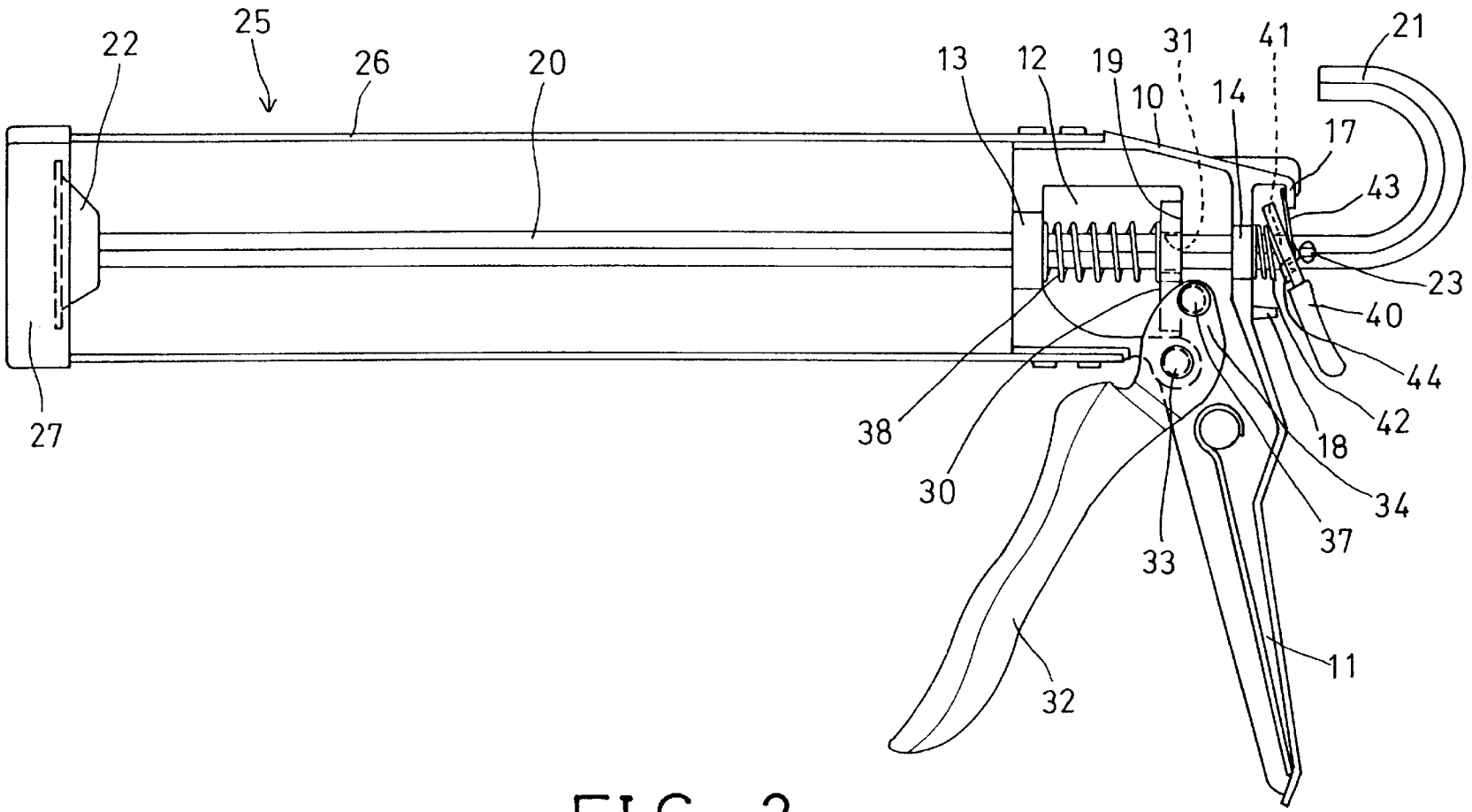
FIG. 2 is a side view of the dispensing gun.
Figure 3:
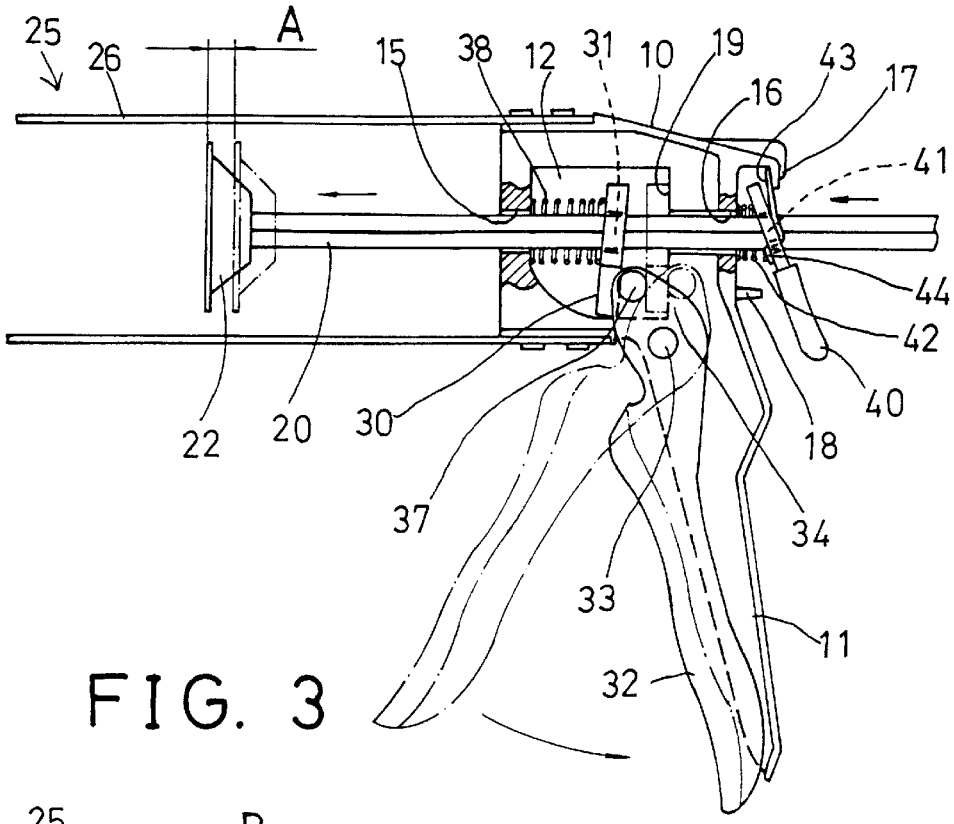
FIGS. 3, 4, 5 are partial cross sectional views illustrating the operation of the dispensing gun.

Referring to the drawings, and initially to FIGS. 1–3, a dispensing gun in accordance with the present invention comprises a stock 10 including a handle 11 extended downwardly and generally perpendicularly to the longitudinal axis of the stock 10, and including an opening 12 formed therein, such as formed in the middle portion thereof, and including two blocks 13, 14 formed or provided in the front and the rear portions thereof respectively, and each having a hexagonal section guide orifice 15, 16 formed therein and communicating with the opening 12 of the stock 10. The stock 10 includes an abutment 17 and an extension or a stop 18 extended rearwardly or laterally from the upper rear and lower rear portions thereof.

A hexagonal push rod 20 is slidably engaged in the hexagonal section guide orifices 15, 16 of the stock 10, and movable forwardly and rearwardly relative to the stock 10, and includes a curved hand grip 21 extended or provided on the rear portion thereof by which the rod 20 may be moved longitudinally, and includes a plunger 22 attached to the front end thereof, and includes one or more nips or projections 23 extended or provided in the rear portion thereof. A frame 25 includes two elongate beams 26 attached or secured to or extended from the front portion of the stock 10, and a ring 27 secured to the front ends of the beams 26 for receiving and holding the cartridge 70 (FIGS. 6–8).

Figure 6:
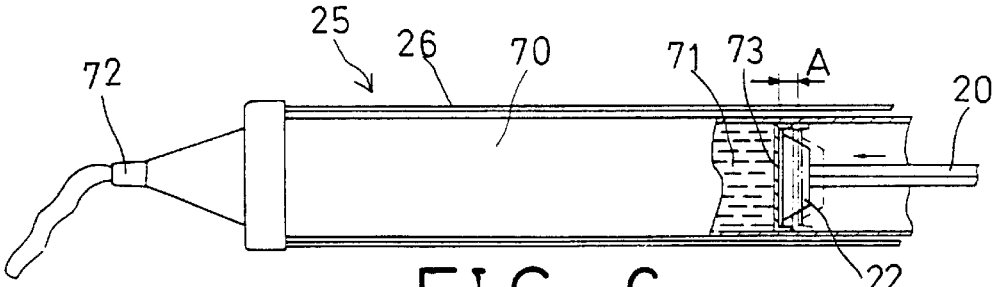
FIGS. 6, 7, 8 are partial cross sectional views illustrating the actuation of the viscous materials or the mastic caulking materials by the dispensing gun.
Figure 7:
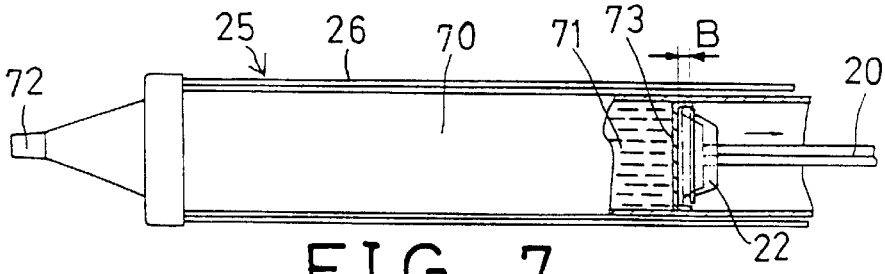
Figure 8:
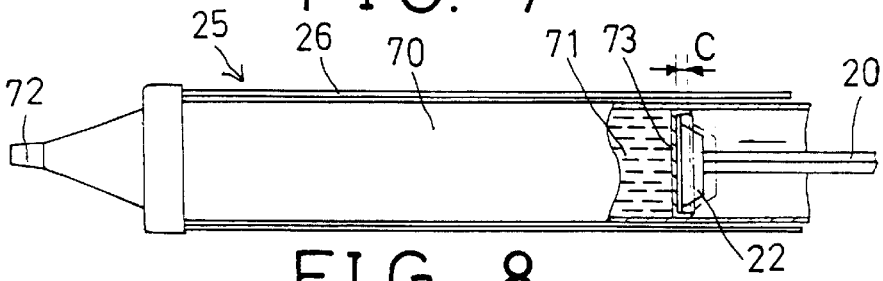

The cartridge 70 as shown in FIGS. 6–8 is generally cylindrical-shaped containing viscous material 71 therein, such as a caulking mastic, and includes a nozzle 72 formed or provided on the front portion thereof, and includes an open rear end having a free cup-shaped piston 73 slidably received therein and slidable or movable along the length of the cartridge 70. The plunger 22 of the rod 20 may be engaged with the piston 73 of the cartridge 70, for moving the piston 73 along the cartridge 70, and thus for forcing the viscous material 71 out of the nozzle 72 of the cartridge 70.

An actuating plate 30 includes a hexagonal aperture 31 formed therein and having a cross section or an area slightly greater than that of the rod 20, for allowing the rod 20 to be slidably received in the aperture 31 of the actuating plate 30. The aperture 31 of the actuating plate 30 is formed or defined by side faces angularly coincident with the corresponding flat surfaces of the rod 20. A trigger 32 has an upper portion rotatably or pivotally secured to the stock 10 or the handle 11 with a pivot axle 33, and includes an actuating upper end having a pair of flanks 34 which are bridged by an actuating pin 37.

A compression spring 38 is engaged around the rod 20, and received in the opening 12 of the stock 10, and engaged between the actuating plate 30 and the block 13 for biasing the actuating plate 30 rightwardly or rearwardly to engage with the actuating pin 37 of the trigger 32. In operation, the actuating plate 30 may be tilted relative to the rod 20 by the actuating pin 37 and thus may engage and hold or grasp the rod 20, in order to move the rod 20 incrementally when the lower portion of the actuating plate 30 is forced or moved forward by the actuating pin 37 of the trigger 32.

The actuating plate 30 may be moved or biased rearwardly by the spring 38, and thus the trigger 32 may be moved away from the handle 11 when the trigger 32 is released. However, it is to be noted that the actuating pin 37 may still be engaged with the lower portion of the actuating plate 30 and thus may still tilt the actuating plate 30 relative to the rod 20 when the actuating plate 30 is moved rearwardly by the spring 38, such that the rod 20 may also be moved rearwardly by the actuating plate 30 when the actuating plate 30 is moved rearwardly by the spring 38.

A release plate 40 includes a hexagonal hole 41 formed therein for loosely receiving the rod 20, and the release plate 40 is loosely held in relation to the stock 10 by the laterally extended abutment 17 projecting from the rear portion of the stock 10. A spring 42 is engaged on or around the rod 20, and biased between the block 14 of the stock 10 and the release plate 40, for biasing the release plate 40 toward or to engage with the laterally extended abutment 17 of the stock 10. The spring 42 may tilt the release plate 40 relative to the rod 20 for preventing the rod 20 from moving rearwardly relative to the release plate 40 or for allowing the rod 20 to move forwardly relative to the release plate 40.

Also, relatively, the release plate 40 may be moved rearwardly together with the rod 20 when the rod 20 and the actuating plate 30 are moved rearwardly by the spring 38, until the release plate 40 is engaged with the abutment 17 of the stock 10. When the release plate 40 is engaged with the abutment 17 of the stock 10, the rod 20 may no longer be moved rearwardly relative to the release plate 40, and the actuating plate 30 may still be moved rearwardly relative to the rod 20 by the spring 38. The above-described configuration is typical and has been disclosed in U.S. Pat. No. 5,217,213 to Lii and U.S. Pat. No. 5,156,305 to Eyre which are taken as references for the present invention.

The dispensing gun in accordance with the present invention further includes a spring member, such as a spring blade, or a spring arm, or an inverted U-shaped spring member 43 having an upper portion engaged with the abutment 17 of the stock 10. The spring member 43 includes a lower portion having one or more legs 44 engaged through or hooked with the middle portion of the release plate 40, for tilting the release plate 40 relative to the rod 20 and/or for biasing the release plate 40 slightly away from the abutment 17 of the stock 10.

In operation, as shown in FIGS. 3 and 6, when the rod 20 is moved forwardly and incrementally by the actuating plate 30 and the trigger 32, the plunger 22 and the piston 73 may be moved forwardly with a moving stroke "A" in order to squeeze the viscous materials 71 out through the nozzle 72 of the cartridge 70. At this moment, the release plate 40 may be slightly moved forwardly or away from the abutment 17 of the stock 10 by the spring member 43. The actuating plate 30 and the trigger 32 thus form an actuating or moving means or device for moving the rod 20 forwardly relative to the stock 10 and the cartridge 70.

Figure 4:
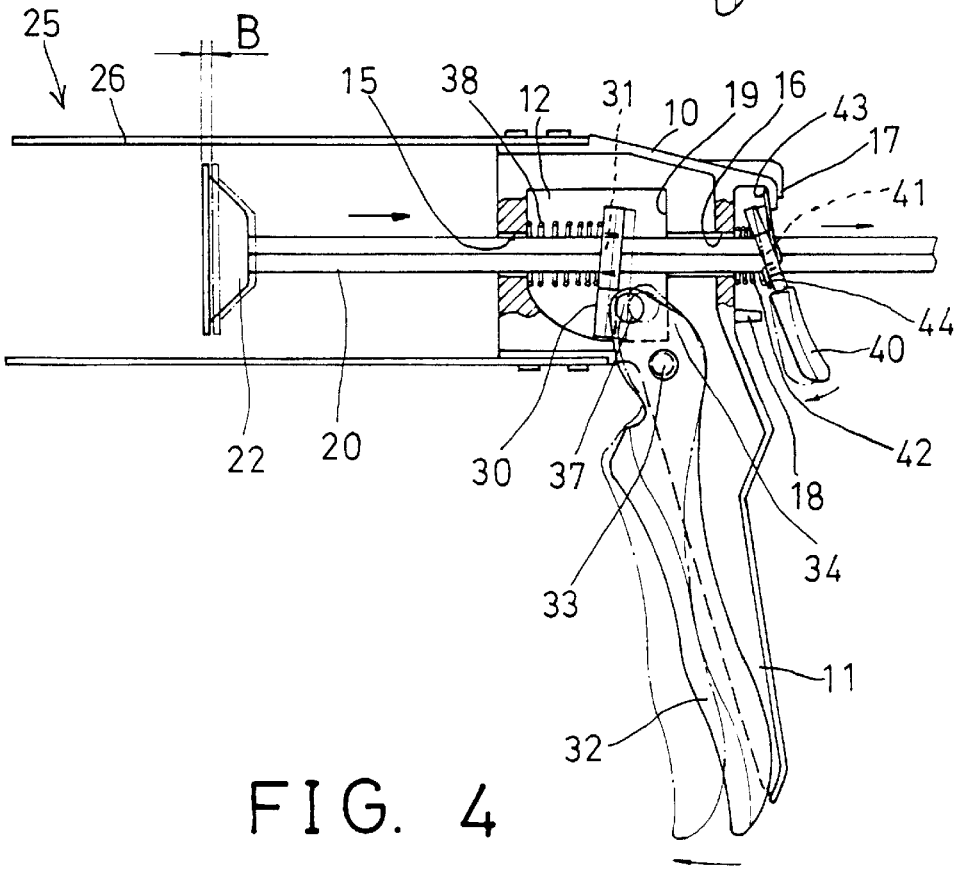

When the trigger 32 is released, the actuating plate 30 may be moved or biased rightwardly or rearwardly by the spring 38. At this moment, the actuating pin 37 may still be engaged with the lower portion of the actuating plate 30 and thus may still tilt the actuating plate 30 relative to the rod 20 such that the rod 20 and the release plate 40 may also be moved rearwardly by the actuating plate 30 and the spring 38 with a moving stroke "B" (FIGS. 4 and 7), until the upper portion of the release plate 40 is engaged with the abutment 17 of the stock 10. The moving stroke "B" is smaller than the moving stroke "A".

When the upper portion of the release plate 40 is engaged with the abutment 17 of the stock 10, the rod 20 is caused to solidly engage with the release plate 40 and may no longer be moved rearwardly relative to the release plate 40. The release plate 40 thus forms a limiting means or device for limiting the rearward movement of the rod 20 relative to the stock 10 and the cartridge 70. When the rod 20 is moved rearwardly by the actuating plate 30 and the spring 38 with the moving stroke "B", the pressure of the plunger 22 against the piston 73 may be released, and thus releasing the viscous materials 71, such that the viscous material 71 may slightly force or move the piston 73 rearwardly, and such that the viscous material 71 will not continuously drip or flow out of the cartridge 70.

Simultaneously, when the upper portion of the release plate 40 is engaged with the abutment 17 of the stock 10 to prevent rearward motion of the rod 20 due to the rod 20 being solidly engaged to the release plate 40, the spring 38 may still bias the actuating plate 30 rearwardly relative to the rod 20 and the stock 10, in which the actuating plate 30 is frictionally moved relative to the rod 20.

When the actuating plate 30 is moved rearwardly relative to the rod 20 and the stock 10 by the spring 38 until the actuating plate 30 is engaged with the stock 10 or engaged with a seat 19 of the stock 10, the spring 38 may force or bias the actuating plate 30 against the stock 10, and may erect the actuating plate 30 relative to the rod 20 or may cause the actuating plate 30 to be perpendicular to the rod 20, such that the rod 20 may be released relative to the actuating plate 30 by the spring 38.

Figure 5:
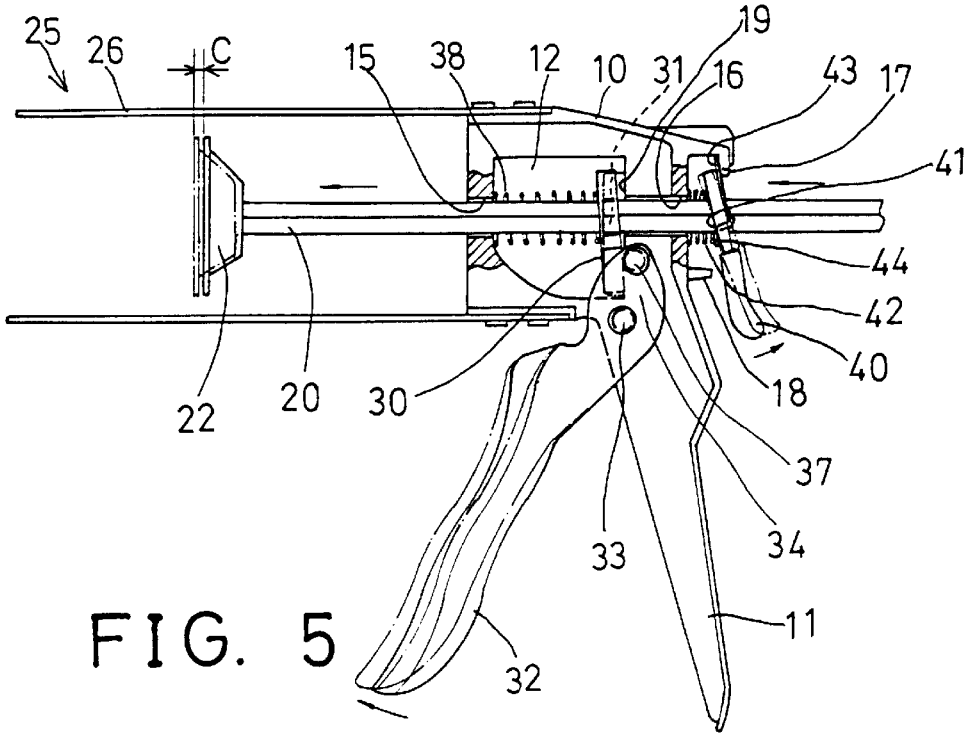

When the rod 20 is released relative to the actuating plate 30 by the spring 38, the spring member 43 may bias and force or move the release plate 40 and the rod 20 slightly forwardly with a return moving stroke "C" which is smaller than the moving stroke "B" as shown in FIGS. 5 and 8, in order to move the plunger 22 to engage with the piston 73 again, and so as to force the air that may be drawn into the cartridge 70 out of the cartridge 70, and for allowing the viscous materials 71 to be solidly forced outward of the cartridge 70 by the piston 73 when the rod 20 is moved forwardly again by the trigger 32. The spring member 43 thus forms a recovering or retrieving means or device for moving the rod 20 backwardly or leftwardly relative to the stock 10 and the cartridge 70.

When the rod 20 and the plunger 22 have been moved forwardly to the forward most position relative to the stock 10, the projections 23 of the rod 20 may be engaged with the release plate 40, and may force the release plate 40 forwardly against the spring 42, until the release plate 40 is engaged with the stop 18 of the stock 10. At this moment, the rod 20 may no longer be moved forwardly by the trigger 32. The rod 20 may be moved or pulled rearwardly relative to the stock 10 again when the lower portion of the release plate 40 is depressed against the spring 42 or when the release plate 40 is erected relative to the rod 20 to a position perpendicular to the rod 20. The rod 20 may be released relative to the release plate 40 when the release plate 40 is perpendicular to the rod 20.

Accordingly, the dispensing gun includes a pressure relieving device for relieving the pressure of the viscous materials or the mastic caulking materials, and for preventing the viscous materials or the mastic caulking materials from moving out of the cartridge continuously, or for preventing the air from moving into the cartridge and for preventing the viscous materials or the mastic caulking materials from being hardened by the air.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A dispensing gun for dispensing a viscous material received in a cartridge, the cartridge including a piston slidably received therein for moving the viscous material out of the cartridge, said dispensing gun comprising:

a stock including a handle extended therefrom, and including at least one guide orifice formed therein, and including a frame for holding the cartridge therein, a rod slidably engaged through said at least one guide orifice of said stock, and including a first end having a plunger provided thereon for engaging with the piston of the cartridge, means for moving said rod forwardly and rearwardly relative to said stock to force the viscous material out of the cartridge, said moving means including an actuating plate having an aperture formed therein for receiving said rod, a trigger pivotally secured to said stock and having an actuating pin for engaging with said actuating plate, and means for biasing said actuating plate to engage with said actuating pin of said trigger, means for limiting a rearward movement of said rod relative to said stock, and means for retrieving said rod forwardly to force said plunger to engage with the piston of the cartridge.

2. The dispensing gun according to claim 1, wherein said limiting means includes an abutment extended from said stock, a release plate having a hole formed therein for loosely receiving said rod, said release plate is engaged with said abutment of said stock to limit the rearward movement of said rod relative to said stock when said release plate is moved rearwardly by said rod.

3. The according to claim 2 further comprising means for biasing said release plate to engage with said abutment of said stock.

4. The according to claim 2 further comprising means for tilting said release plate relative to said rod.

5. The dispensing gun according to claim 2, wherein said retrieving means includes a spring member having a first portion engaged with said abutment, and having a second portion engaged with said release plate, to bias said release plate away from said abutment of said stock.

6. The dispensing gun according to claim 5, wherein said second portion of said spring member includes at least one leg engaged through and hooked with said release plate.

* * * * *